US007299937B2

(12) United States Patent
Antier et al.

(10) Patent No.: US 7,299,937 B2
(45) Date of Patent: Nov. 27, 2007

(54) CLOSURE DEVICE WITH MEANS FOR STORING A TAMPER-EVIDENT TAB AND CONTAINER EQUIPPED WITH SUCH A CLOSURE DEVICE

(75) Inventors: Gregory Antier, Trevoux (FR); Georges Adabachian, Trevoux (FR)

(73) Assignee: Tetra Laval Holdings & Finance S.A., Ch-Pully (CH)

( * ) Notice: Subject to any disclaimer, the term of this patent is extended or adjusted under 35 U.S.C. 154(b) by 147 days.

(21) Appl. No.: 10/500,292

(22) PCT Filed: Jan. 2, 2003

(86) PCT No.: PCT/FR03/00003

§ 371 (c)(1),
(2), (4) Date: Jun. 29, 2004

(87) PCT Pub. No.: WO03/059770

PCT Pub. Date: Jul. 24, 2003

(65) Prior Publication Data

US 2004/0245206 A1 Dec. 9, 2004

(30) Foreign Application Priority Data

Jan. 3, 2002 (FR) ..... 02 00048

(51) Int. Cl.
*B65D 41/48* (2006.01)
*B65D 43/16* (2006.01)

(52) U.S. Cl. ..... 215/235; 215/237; 215/253; 215/216; 215/254; 222/153.06

(58) Field of Classification Search ..... 215/235, 215/237, 216, 253, 254; 220/266, 270; 222/153.07, 222/153.14, 541.6, 541.9
See application file for complete search history.

(56) References Cited

U.S. PATENT DOCUMENTS

| | | | | |
|---|---|---|---|---|
| 3,994,409 | A | 11/1976 | Nightengale | |
| 4,487,324 | A * | 12/1984 | Ostrowsky | 215/253 |
| 4,557,393 | A | 12/1985 | Boik | |
| 4,919,286 | A * | 4/1990 | Agbay, Sr. | 215/235 |
| 5,215,204 | A * | 6/1993 | Beck et al. | 215/252 |
| 5,873,475 | A * | 2/1999 | Volpe | 215/207 |
| 6,000,568 | A * | 12/1999 | Verter | 215/252 |
| 6,851,586 | B2 * | 2/2005 | Odet | 222/541.9 |
| 2002/0088813 | A1 * | 7/2002 | Nyman et al. | 220/832 |
| 2003/0089746 | A1 * | 5/2003 | Odet | 222/541.5 |

* cited by examiner

*Primary Examiner*—Robin A. Hylton
(74) *Attorney, Agent, or Firm*—Dowell & Dowell, P.C.

(57) ABSTRACT

A device for closing a container and a container equipped with such a device, wherein the device includes: a first portion forming a closure element; a second annular portion positioned around a neck; a third portion forming a tamper-evident tab linking the first portion to the second portion, and which is connected to the first and second portions by frangible means so that the tamper-evident tab must be removed upon first use so as to release the closure element; and storage means for allowing the insertion of the tamper-evident tab therein once the tamper-evident tab has been separated from the first and second portions.

13 Claims, 6 Drawing Sheets

CLOSURE DEVICE WITH MEANS FOR STORING A TAMPER-EVIDENT TAB AND CONTAINER EQUIPPED WITH SUCH A CLOSURE DEVICE

The present invention relates to a device for closing a container provided with a neck, this device being of the type comprising:

- a first portion forming a closure element,
- a second, annular portion, intended to be maintained around the neck, and
- a third portion which forms a tamper-evident tongue or tab linking the first to the second portion, which is connected to these first and second portions by frangible means and which is intended to be removed upon first use in order to release the closure element.

The invention also relates to a container provided with a neck on which a closure device of the above-mentioned type is mounted.

When such a container is opened for the first time, the tamper-evident tab is removed, tearing the frangible means, so that the closure element can be moved away from the neck.

In many cases, the user then does not know what to do with this tamper-evident tab which hampers him/her, constituting a nuisance.

Moreover, it happens that the cumbersome tamper-evident tab is thrown away anywhere, with the result that the nuisance which has just been mentioned is sometimes coupled with a pollution of the environment, even though the closure device is generally made of a recyclable material.

American patent U.S. Pat. No. 3,994,409 describes a closure provided for a container. This closure comprises an annular skirt divided by two lines of lesser resistance in a retaining ring, a closure element and a tamper-evident tab. One of these two lines of lesser resistance is designed as a closed loop, while the other line of lesser resistance presents an interruption. Consequently, the tamper-evident tab can be totally detached only from the retaining ring by pulling on an ear provided at the end of this tamper-evident tab. As it remains joined to the closure element, this tamper-evident tab presents the drawback of being unaesthetic and the drawback of risking injuring the user and/or of catching on objects which might consequently tip over and fall.

A closure device incorporating a completely separable tab does not present such drawbacks, since its tamper-evident tab is intended to be removed from the first and second portions of the device.

It is at least one object of the invention to render the closure devices of the afore-mentioned type more practical.

To that end, it has for its object a closure device of that type, characterized in that it defines means for storing the tamper-evident tab, once this tamper-evident tab has been separated from the first and second portions.

The invention also has for an object a container provided with a neck, characterized in that it comprises a closure device as defined hereinabove, mounted on the neck.

The invention will be more readily understood on reading the following description, given solely by way of example and made with reference to the accompanying drawings, in which.

Figure 3:
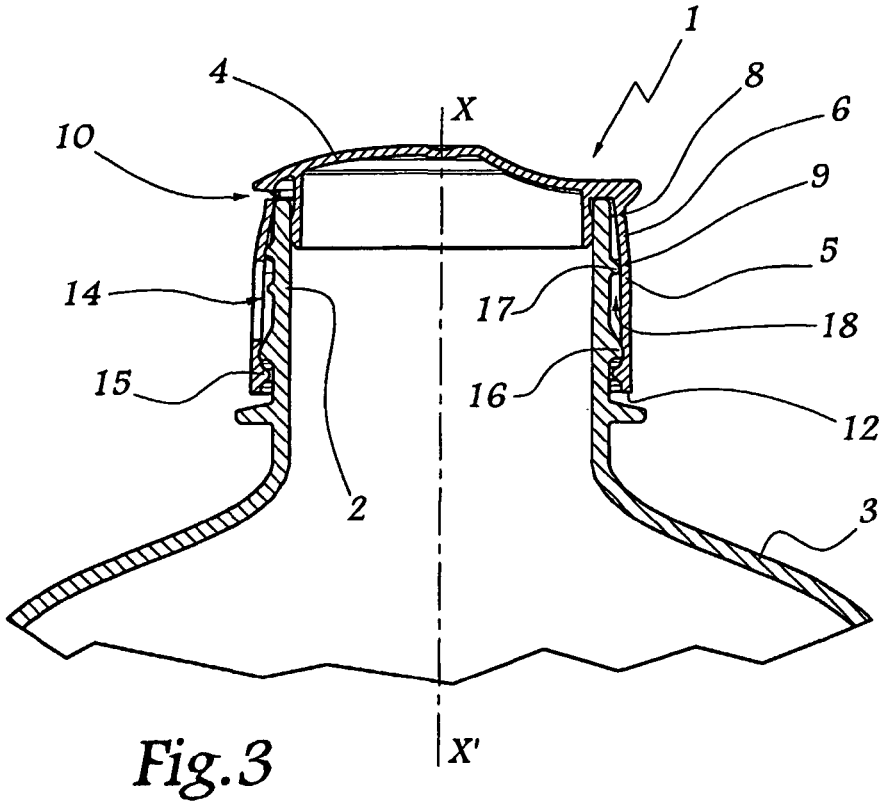
FIG. 3 is a view in axial section of the neck of a container according to the invention and closed by the closure device of FIGS. 1 and 2.
Figure 7:
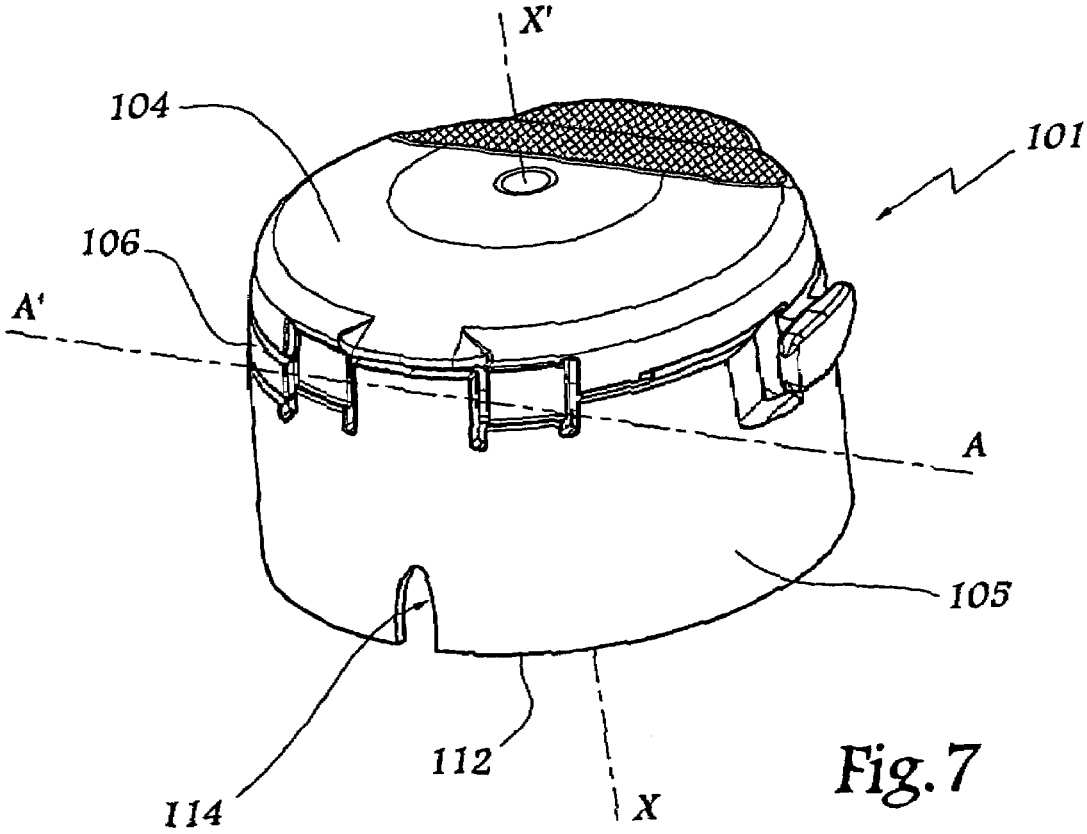
FIG. 7 is a view similar to FIG. 3 and shows a closure device in accordance with a first variant embodiment of the invention.
Figure 8:
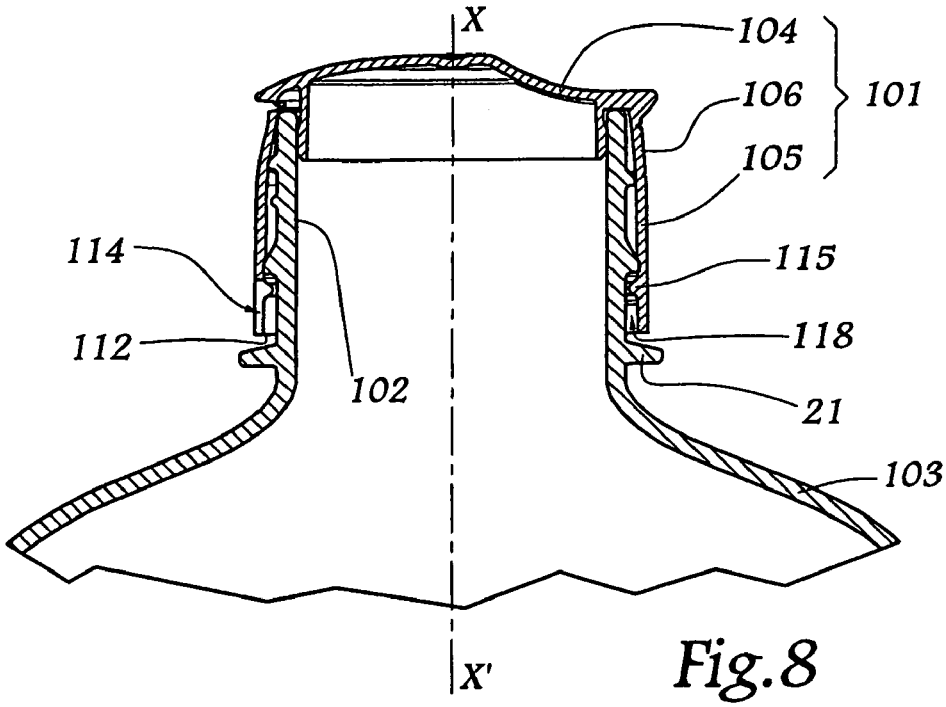

FIG. 8, which corresponds to FIG. 3, is an axial section of the neck of a container according to the invention and closed by the closure device shown in FIG. 7.

Figure 6:
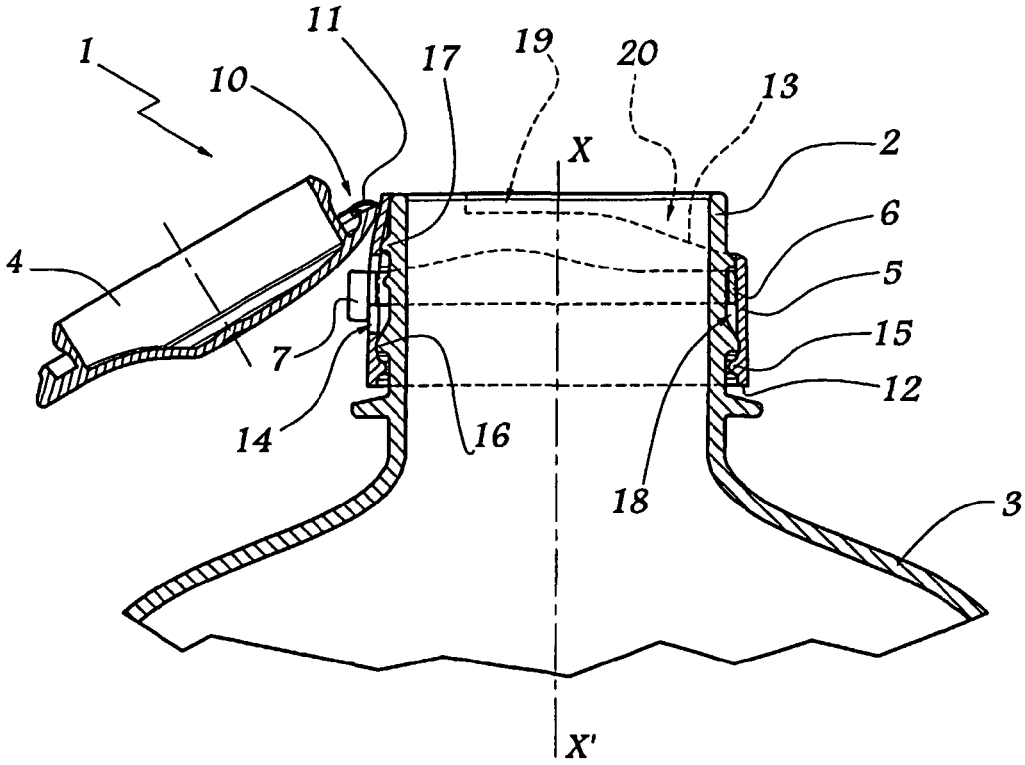
FIG. 6 is a view similar to FIG. 3 and shows the assembly of FIGS. 3 to 5 of which the tamper-evident tab is stored after having been removed.
Figure 4:
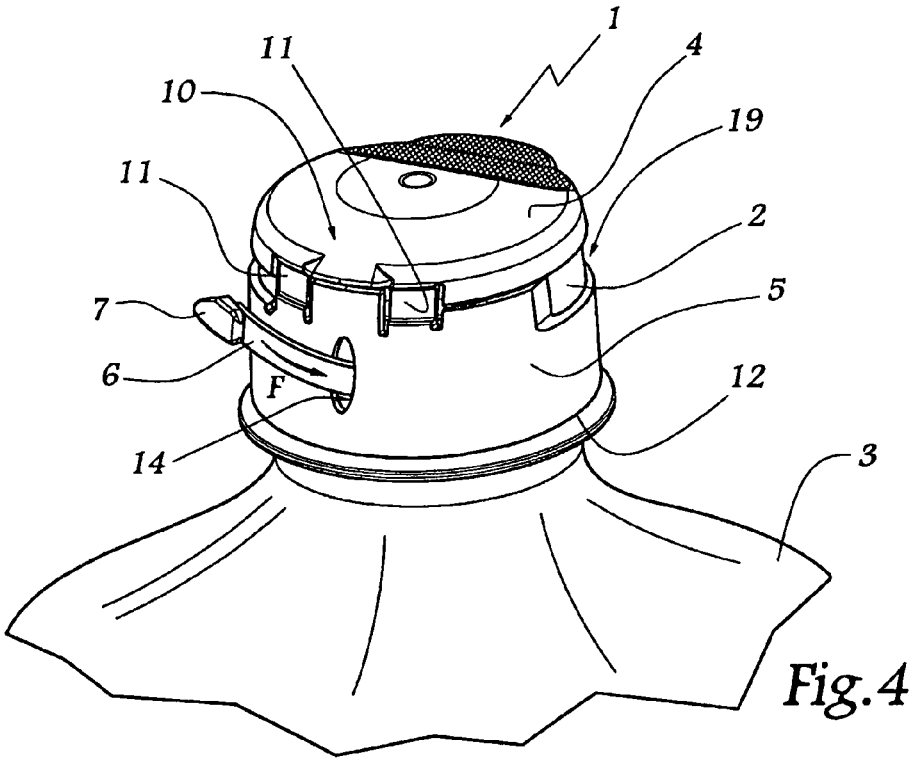
FIGS. 4 and 5 are two similar views, in perspective, of the assembly of FIG. 3 and respectively illustrating a step of storing a tamper-evident tab removed from the closure device of this assembly, and the final position of this stored tamper-evident tab.
Figure 5:
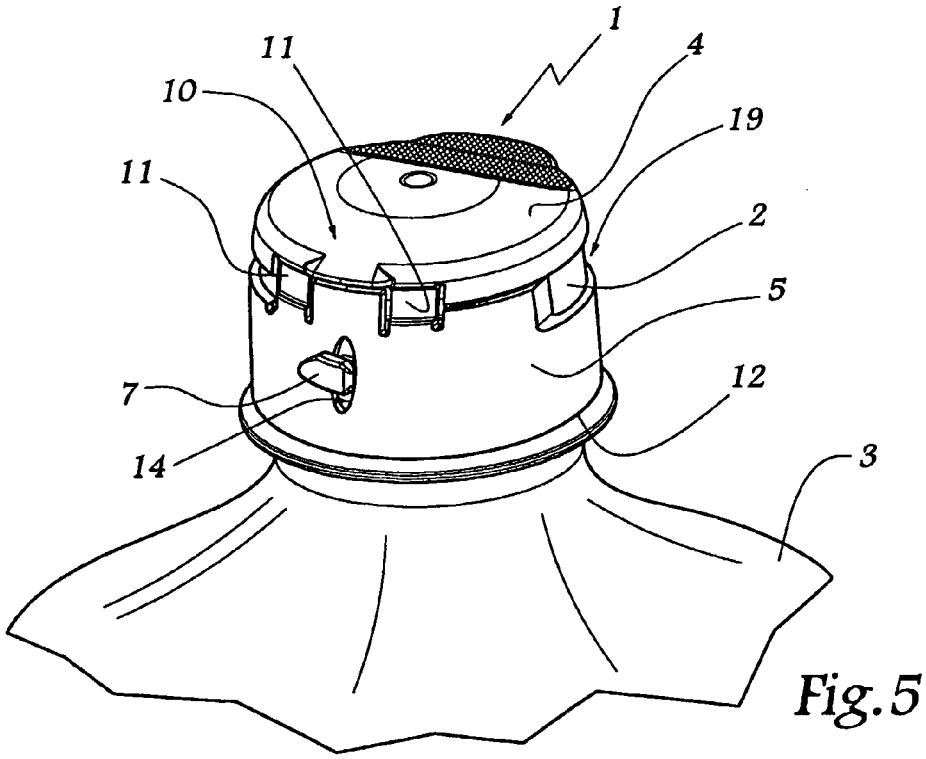
Figure 9:
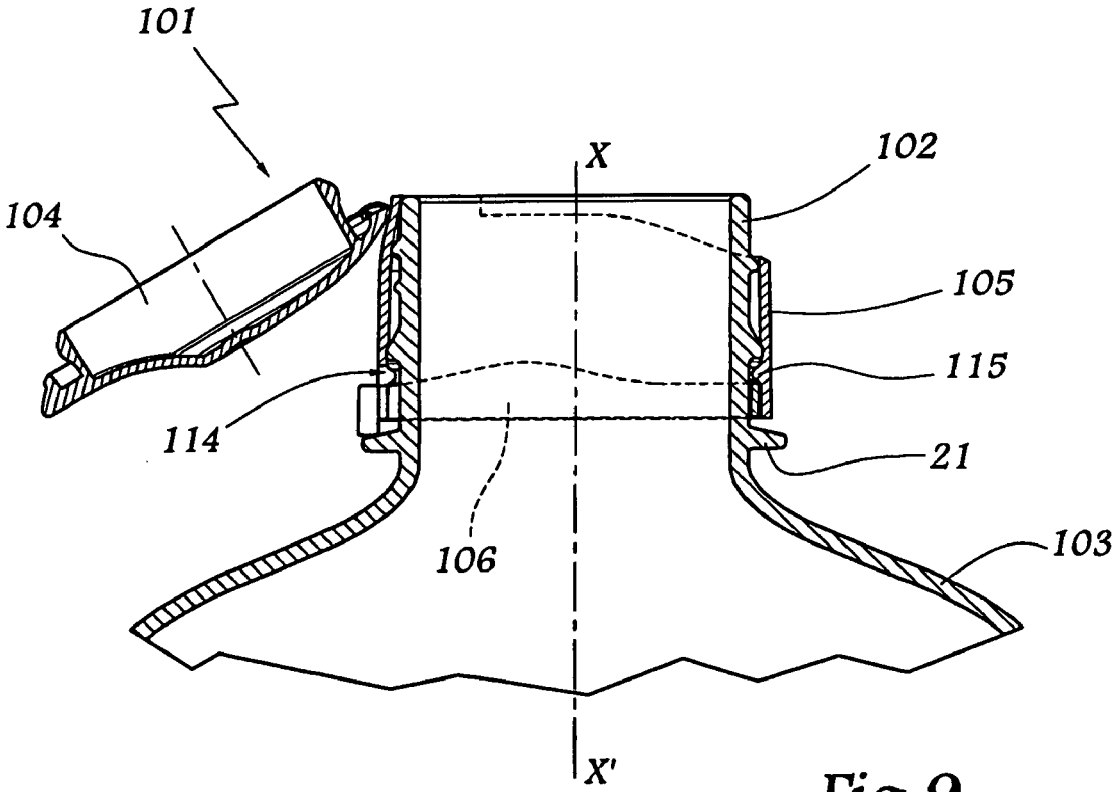
Figure 10:
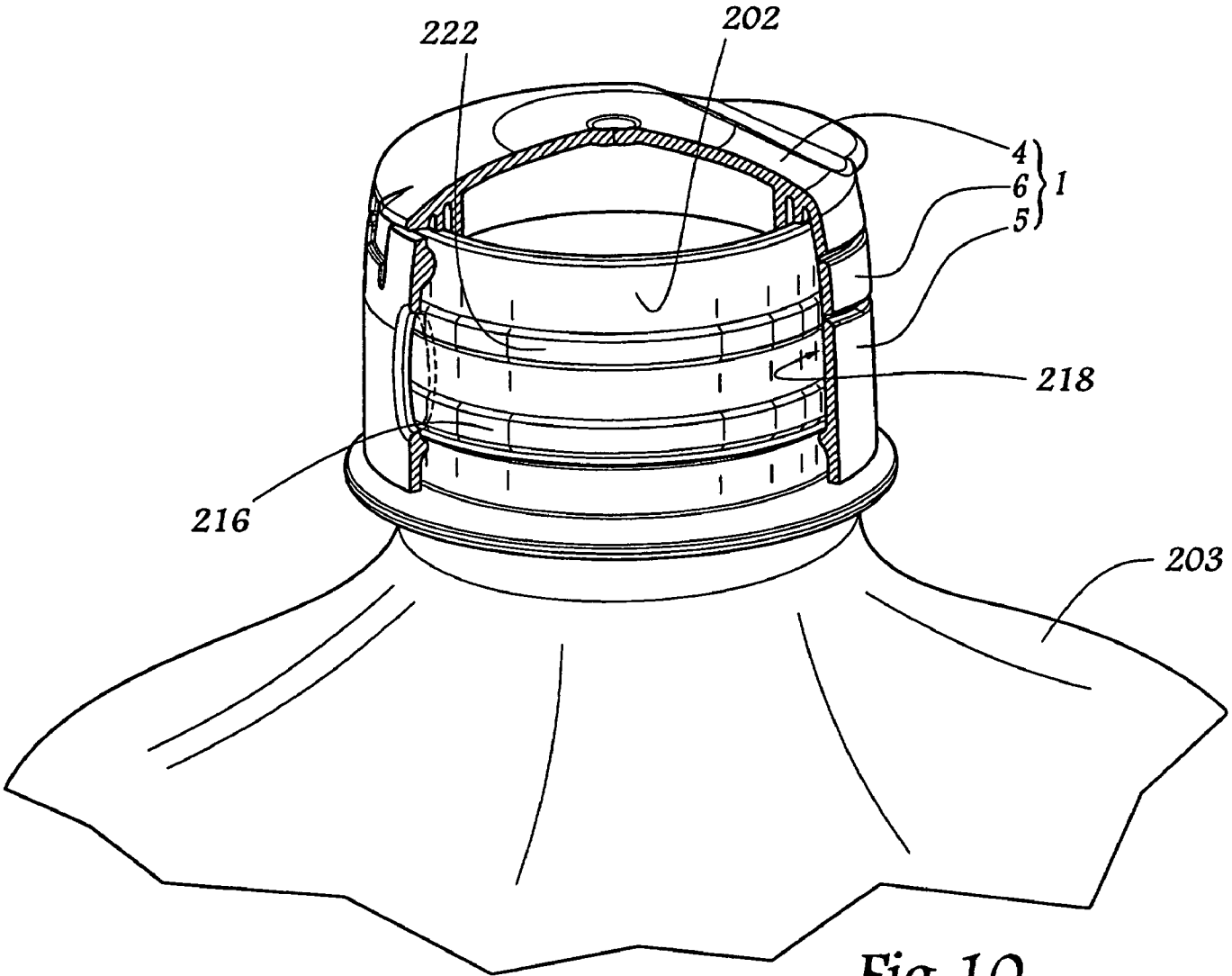

FIG. 9, which corresponds to FIG. 6, is an axial section of the assembly of FIG. 8, in which a tamper-evident tab has been stored after having been removed from the closure device; and FIG. 10 is a partial view in perspective, with parts torn away, of a container in accordance with a second variant embodiment of the invention.

In FIGS. 1 to 6, a closure device 1 is shown either alone, or mounted on the neck 2 of a container, which is a bottle 3 shown partially.

Figure 1:
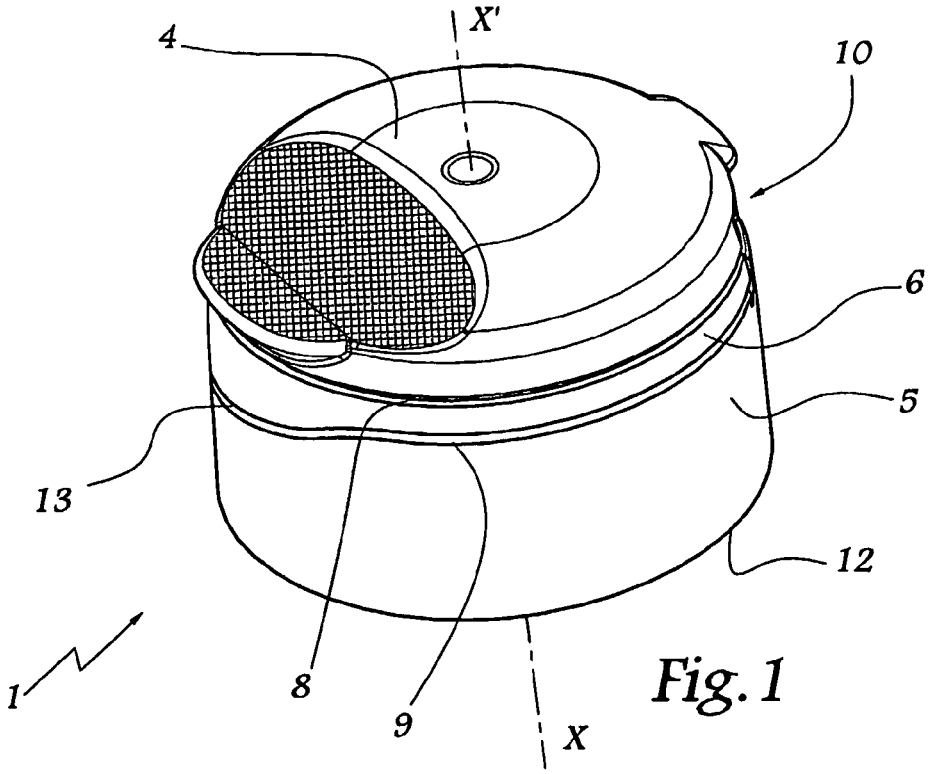
FIG. 1 is a first view in perspective of a closure device according to the invention.
Figure 2:
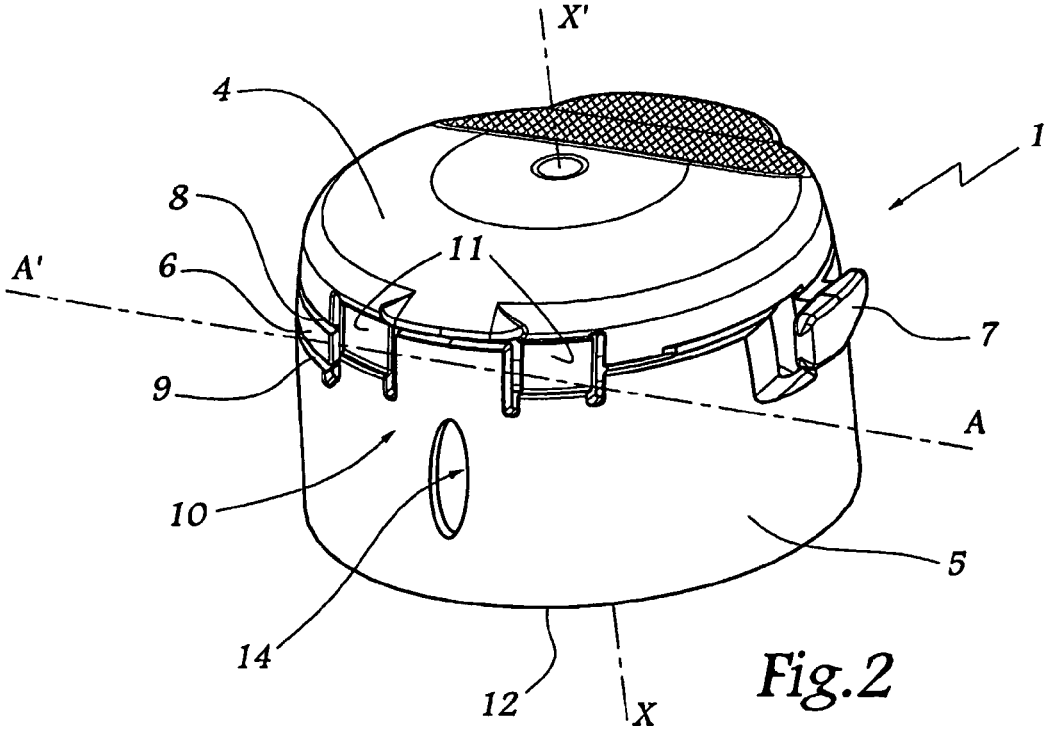
FIG. 2 is a second view in perspective of the closure device shown from another angle from FIG. 1.

More precisely, in FIGS. 1 to 3, the closure device 1, made by moulding plastics material, is still intact or untouched. It is, in that case, in one piece and essentially symmetrical with respect to an axis X-X'. It comprises three portions, of which one forms a closure element 4, and another is an annular skirt 5 for mounting the device 1 on the neck 2. The last portion, which extends between the other two, about axis X-X', is a tamper-evident tab 6 which, until it is removed from the device 1, links the closure element 4 to the skirt 5.

One of the two ends of the tamper-evident tab 6 is provided with a member 7 for grasping.

Frangible means, intended to be torn when the tamper-evident tab 6 is being removed, comprise two continuous lines of lesser mechanical resistance 8 and 9, each resulting from the presence of a groove on the outer face of the closure device 1. The line of lesser mechanical resistance 8 extends between the tamper-evident tab 6 and the closure element 4. The line of lesser mechanical resistance 9 extends between the tamper-evident tab 6 and the skirt 5.

A hinge 10, of pivot axis A-A', is provided between the two ends of the tamper-evident tab 6 and comprises two elastic blades 11 which join the closure element 4 to the skirt 5 and are offset angularly about axis X-X with respect to each other.

At a certain distance from each of its two ends, the line of lesser mechanical resistance 9 inclines towards the toward a free edge 12 of the skirt 5, then defines a bow 13, having a concavity that faces toward the closure element 4 and that extends diametrically opposite the hinge 10.

A hole 14, elongated in a direction substantially parallel to axis X-X', passes right through the wall of the skirt 5. It has substantially the same angular position about axis X-X' as the hinge 10. It forms means for storing the tamper-evident tab 6 which may be passed inside it, once the lines of lesser resistance 8 and 9 are torn.

In FIG. 3, the closure device 1 is mounted on the neck 2. The skirt 5 is in that case retained around this neck 2 by clipping means constituted by two complementary annular beads, of which one is referenced 15 and provided inside the skirt 5, and of which the other is referenced 16 and provided outside the neck 2.

The neck 2 presents an outer, helical thread 17, onto which a cap (not shown) may be screwed on the neck 2, in the absence of the closure device 1. This thread is axially offset toward the free edge of the neck 2 with respect to the bead 16. Between the bead 16 and thread 17, the skirt 5 and the neck 2 define an annular storage space 18, to which the hole 14 provides access.

As long as the lines of lesser resistance 8 and 9 are not torn, the tamper-evident tab 6 opposes removal of the closure element 4, which hermetically closes the passage defined by the neck 2.

When the bottle 3 is opened for the first time, the tamper-evident tab 6, gripped via the grasping member 7, is totally removed, tearing the lines of lesser resistance 8 and 9, this releasing the closure device 4 which may in that case be pivoted about axis A-A' of the hinge 10, away from the neck 2, into the position illustrated in FIG. 6.

In accordance with the object of the invention, the user is in that case no longer hindered by the removed tamper-evident tab 6, since he/she may slide it in the storage space 18, through the hole 14. To that end, he/she begins by inserting the end of this tamper-evident tab 6 opposite the grasp member 7 into the hole 14, then into the storage space 18. The tamper-evident tab 6 is then made to progressively penetrate in the storage space 18, by exertion of a thrust symbolized by arrow F in FIG. 4. As the frangible means are formed by two continuous lines of lesser mechanical resistance, the lateral edges of the tamper-evident tab 6 are substantially regular, so that this tamper-evident tab passes in the hole 14 without catching.

The tamper-evident tab 6 may be pushed in this way until the grasp member 7 abuts against the edge of the hole 14 and is blocked at the entrance of the storage space 18. The tamper-evident tab 6 is then in the position illustrated in FIGS. 5 and 6: it is mounted, or if preferred, is stored, in the storage space 18 and only its grasping member 7 projects to the outside. However, since it is hidden by the open closure element 4 as shown in FIG. 6, this grasp member 7 is not in the way when the contents of the bottle 3 are poured into another recipient or when a user is drinking from the neck by placing his/her mouth opposite the hinge 10.

Furthermore, the hole 14 facilitates rapid draining of a liquid that may be imprisoned between the neck 2 and the skirt 5 when the closure device 1 is mounted and/or it promotes and accelerates evaporation of this liquid which may be a residue of a foodstuff poured in the bottle 3 or of rinsing water.

As shown in FIG. 6, the removal to fhte tamper-evident tab 6 leaves a notch 19 in the skirt 5. At the level of the bow 13, the edge of the notch 19 defines another notch 20, which is smaller, deeper, and located opposite the hinge 10. This small notch 20 thus uncovers the neck 2 over a longer length precisely where a possible user drinking from the neck 2 is likely to apply his/her lower lip.

A closure device 101 according to a first variant embodiment of the invention is shown in FIGS. 7 to 9. In FIGS. 8 and 9, it is mounted on the neck 102 of a bottle 103 in accordance with this first variant embodiment of the invention. Only what distinguishes the closure device 101 and the bottle 103 from the closure device 1 and the bottle 3 will be described hereinafter. Moreover, the references designating parts of this closure device 101 or of this bottle 103 will be constructed by increasing by 100 the references designating similar parts of the device 1 or of the bottle 3.

The neck 102 and the skirt 105 are respectively longer than the neck 2 and the skirt 5.

With respect to the storage space 118, the storage space 118 is offset axially and extends between the inner bead 115 of the skirt 105 and the free edge 112 of this skirt 105, as may be seen in FIG. 8.

Contrary to the case of the closure device 1, the passage formed through the wall of the skirt 105, in order to provide access to the storage space 118, is not formed by a hole, but by a notch 114, defined from the free edge 112 and elongated in the direction of the closure element 104.

In FIG. 9, the tamper-evident tab 106 is stored inside the storage space 118. A radial ring 21, provided for manipulating the bottle 103 and equipping the neck 102, in that case opposes a possible axial displacement of the tamper-evident tab 106 outside the housing 118.

A bottle 203 in accordance with a second variant embodiment of the invention is shown in FIG. 10. In the following, only what distinguishes this bottle 203 from the bottle 3 is described. Moreover, certain references designating parts of this bottle 203 are constructed by increasing by 200 the references designating the similar parts on bottle 3.

The neck 202 of the bottle 203 is bereft of the thread 17 of the bottle 3. On the other hand, it defines an annular bead 222. The latter extends outwardly of the neck 202, between the annular bead 216 and the free edge of this neck 202.

A closure device 1 identical to that shown in FIGS. 1 to 6, is mounted on the neck 202, in the same manner as the closure device 1 shown in FIGS. 1 to 6 is mounted on the neck 2 of the bottle 3, in FIGS. 3 to 6. The skirt 5, inside which is located the annular bead 222, is applied on the latter. Consequently, the storage space 218 is jointly defined by the skirt 5 and the neck 202, as well, laterally, as by the annular beads 222 and 216.

During storage of the tamper-evident tab 6, these annular beads 222 and 216 guide and confine this tamper-evident tab 6 in the storage space 218.

In a variant, the annular bead 222 may be defined not by the neck of the bottle, but the skirt 5 of the closure device 1.

Among the advantages of the invention, it will be noted that the presence of a passage through the wall of the skirt 5 or 105 results in a saving of material and therefore in saving of money.

The invention claimed is:

1. A device for closing a container provided with a neck, the device comprising:

a first portion forming a closure element;

a second annular portion positioned around the neck, the second portion including a wall forming an annular skirt;

a third portion which forms a tamper-evident tab linking the first portion to the second portion, and which is connected to the first and second portions by frangible means so that the tamper-evident tab must be removed upon first use in order to release the closure element;

a storage space defined between the skirt and the neck; and a passage through the wall of the skirt that allows access to the storage space so that the tamper-evident tab can be inserted therein once the tamper-evident tab has been separated from the first and second portions.

2. The device according to claim 1, wherein the passage is formed by a hole.

3. The device according to claim 1, wherein, opposite the closure element, the skirt terminates in a free edge which defines a notch forming the passage.

4. The device according to claim 1, wherein, on each side of the tamper-evident tab, the frangible means is a continuous line of lesser mechanical resistance.

5. The device according to claim 1, further comprising a hinge that links the closure element to the second portion, and wherein the frangible means includes at least one line of lesser mechanical resistance which extends between the tamper-evident tab and the second portion, and, diametrically opposite the hinge, defines an edge of a notch that is defined by the second portion and uncovers a part of the neck after the tamper-evident tab has been removed.

6. A container comprising:

a body having a neck and a closure device for closing an opening in the neck of the container, the closure device including a first portion forming a closure element, a second annular portion positioned around the neck, the second portion including a wall forming an annular skirt, and a third portion which forms a tamper-evident tab linking the first portion to the second portion, and which is connected to the first and second portions by frangible means so that the tamper-evident tab must be removed upon first use in order to release the closure element;

a storage space between the skirt and the neck; and a passage through the wall of the skirt that allows access to the storage space so that the tamper-evident tab can be inserted therein once the tamper-evident tab has been separated from the first and second portions.

7. The container according to claim 6, wherein at least one of the elements of the group consisting of the neck and the skirt of the closure device, defines at least one guide for confining the tamper-evident tab in the interior storage space.

8. The container according to claim 7, wherein the at least one guide for confining is an annular projection laterally defining the interior storage space.

9. The container according to claim 6, wherein the passage is formed by a hole.

10. The container according to claim 6, wherein, opposite the closure element, the skirt terminates in a free edge which defines a notch forming the passage.

11. The container according to claim 6, wherein on each side of the tamper-evident tab the frangible means is a continuous line of lesser mechanical resistance.

12. The container according to claim 6, further comprising a hinge that links the closure element to the second portion, and wherein the frangible means includes at least one line of lesser mechanical resistance which extends between the tamper-evident tab and the second portion, and, diametrically opposite the hinge, defines an edge of a notch that is defined by the second portion and uncovers a part of the neck after the tamper-evident tab has been removed.

13. The container according to claim 10, wherein, at the notch, the neck projects further than the second portion.

* * * * *